US008763336B2

(12) United States Patent
Gulbrandsen et al.

(10) Patent No.: US 8,763,336 B2
(45) Date of Patent: Jul. 1, 2014

(54) ATTACHMENT CLIP FOR CEILING GRID SYSTEMS

(71) Applicant: USG Interiors, LLC, Chicago, IL (US)

(72) Inventors: Peder Gulbrandsen, Aurora, IL (US); Mark Miklosz, Western Springs, IL (US); Nicholas Jackson, Carol Stream, IL (US); Stephen Oshgan, Des Plaines, IL (US); Joe Wascow, Vernon Hills, IL (US); Jeremy Bruce, Bolingbrook, IL (US)

(73) Assignee: USG Interiors, LLC, Chicago, IL (US)

( * ) Notice: Subject to any disclaimer, the term of this patent is extended or adjusted under 35 U.S.C. 154(b) by 0 days.

(21) Appl. No.: 13/776,974

(22) Filed: Feb. 26, 2013

(65) Prior Publication Data

US 2013/0227908 A1 Sep. 5, 2013

Related U.S. Application Data

(60) Provisional application No. 61/605,473, filed on Mar. 1, 2012.

(51) Int. Cl.
*E04B 2/00* (2006.01)

(52) U.S. Cl.
USPC ..... 52/506.07; 52/288.1; 52/506.08

(58) Field of Classification Search
USPC ..... 52/506.07, 506.08, 287.1, 288.1
See application file for complete search history.

(56) References Cited

U.S. PATENT DOCUMENTS

| | | | | | |
|---|---|---|---|---|---|
| 2,217,574 | A | * | 10/1940 | Tinnerman | 52/718.06 |
| 3,294,428 | A | * | 12/1966 | Lickliter et al. | 403/52 |
| 3,742,668 | A | * | 7/1973 | Oliver | 52/288.1 |
| 3,798,865 | A | * | 3/1974 | Curtis | 52/665 |
| 3,823,251 | A | * | 7/1974 | Heithecker et al. | 174/498 |
| 3,898,782 | A | * | 8/1975 | Donato | 52/506.08 |
| 4,580,386 | A | * | 4/1986 | Hemphill et al. | 52/664 |
| 4,642,957 | A | * | 2/1987 | Edwards | 52/242 |
| 4,663,911 | A | * | 5/1987 | Gracia | 52/506.06 |
| 4,725,083 | A | * | 2/1988 | Schauer | 285/405 |
| 4,850,172 | A | * | 7/1989 | Gailey et al. | 52/665 |
| 5,154,031 | A | * | 10/1992 | Wall | 52/506.06 |
| 5,195,289 | A | * | 3/1993 | LaLonde et al. | 52/506.06 |

(Continued)

OTHER PUBLICATIONS

International Search Report and Written Opinion of the International Searching Authority dated Jun. 21, 2013 for corresponding International Application No. PCT/US20131027864, filed Feb. 27, 2013.

*Primary Examiner* — Basil Katcheves
*Assistant Examiner* — Joshua Ihezie
(74) *Attorney, Agent, or Firm* — Pearne & Gordon LLP

(57) ABSTRACT

A clip having a first leg for attaching to a trim strip and a second leg for attaching to a grid runner, the first leg having a backer plate attached with a screw through a slot, a head of the screw on a side of the first leg facing the second leg, the backer plate on the other side of the first leg, an upper edge of the first leg in a downwardly facing groove on a backside of the trim strip, the backer plate fitting between a depending free edge of the upper groove and an upstanding edge of a lower upwardly facing groove when the screw is up in the slot, and being received in the lower groove when the screw is down in the slot and clamping between the upstanding edge and a rear face of the trim strip when the screw is tightened.

6 Claims, 2 Drawing Sheets

(56) References Cited

U.S. PATENT DOCUMENTS

| | | | | |
|---|---|---|---|---|
| 5,309,686 | A * | 5/1994 | Underwood et al. | 52/29 |
| 5,313,759 | A * | 5/1994 | Chase, III | 52/506.06 |
| 5,350,227 | A * | 9/1994 | Katz | 312/198 |
| 5,359,817 | A * | 11/1994 | Fulton | 52/288.1 |
| 5,426,901 | A * | 6/1995 | Indracek | 52/288.1 |
| 5,572,844 | A * | 11/1996 | Stackenwalt et al. | 52/506.07 |
| 5,678,379 | A * | 10/1997 | Quattrociocchi | 52/712 |
| 5,732,747 | A * | 3/1998 | Holliday | 138/163 |
| 5,937,605 | A * | 8/1999 | Wendt | 52/506.06 |
| 6,018,923 | A * | 2/2000 | Wendt | 52/712 |
| 6,138,425 | A * | 10/2000 | Wendt | 52/506.07 |
| 6,141,926 | A * | 11/2000 | Rossiter et al. | 52/239 |
| 6,763,641 | B1 * | 7/2004 | Ahren et al. | 52/506.06 |
| 6,880,302 | B1 * | 4/2005 | Fontaine | 52/222 |
| 7,461,484 | B2 * | 12/2008 | Battey et al. | 52/220.7 |
| 7,788,872 | B2 * | 9/2010 | Platt | 52/665 |
| 7,930,864 | B2 | 4/2011 | Wendt | |
| D638,287 | S * | 5/2011 | Tedesco et al. | D8/394 |
| 8,006,454 | B2 * | 8/2011 | Jankovec et al. | 52/506.07 |
| 8,522,498 | B2 * | 9/2013 | Picken | 52/287.1 |
| 8,534,016 | B2 * | 9/2013 | DePaul | 52/288.1 |
| 2002/0152704 | A1 * | 10/2002 | Thompson et al. | 52/506.06 |
| 2003/0177735 | A1 * | 9/2003 | Seeba et al. | 52/726.2 |
| 2003/0230043 | A1 * | 12/2003 | Likozar et al. | 52/506.07 |
| 2005/0034410 | A1 * | 2/2005 | Stackenwalt | 52/716.1 |
| 2006/0102883 | A1 * | 5/2006 | Troutman et al. | 256/13.1 |
| 2007/0130869 | A1 * | 6/2007 | Platt | 52/506.08 |
| 2011/0226919 | A1 * | 9/2011 | Fryzek et al. | 248/298.1 |
| 2013/0180202 | A1 * | 7/2013 | Woods et al. | 52/710 |

* cited by examiner

ATTACHMENT CLIP FOR CEILING GRID SYSTEMS

This application claims the benefit of U.S. provisional patent application Ser. No. 61/605,473, filed Mar. 1, 2012.

The invention relates to a clip for attaching perimeter trim to a suspended ceiling grid.

BACKGROUND OF THE INVENTION

Suspended ceiling systems can include so-called island ceilings and fascias where all or a part of a perimeter of a ceiling is spaced from any wall. Various trim products and related accessories have been developed to provide a finished look for these wall-free ceiling perimeters. One style of trim is an aluminum extrusion formed with integral, mutually facing channels forming an attachment track on a rear face of the extrusion.

Clips have been devised to attach the perimeter trim to suspended ceiling grid runners. U.S. Pat. No. 7,930,864 discloses an example of the prior art. Prior art clips, when being installed, can cause distortion of the trim if overly tightened, and can be expensive to manufacture. Thus, there has been a need for an easy to use clip for reliably attaching a perimeter trim strip to a suspended ceiling grid while avoiding damage from over tightening.

SUMMARY OF THE INVENTION

The invention provides an improved attachment clip for suspended ceiling perimeter trim that is quick and easy to position on a trim strip and that avoids the risk of damage to the strip in the event of over tightening.

The disclosed clip has a main body with divergent legs, one for attachment to the trim strip and the other for attachment to a grid runner. A backer plate is slidably mounted on the trim attachment leg between retracted and extended positions. The backer plate retracted position allows the clip to be installed from any point along the length of a trim strip rather than by sliding it from an end of the trim strip. The clip geometry permits the clip to hang, cantilever fashion, on the trim strip during initial assembly without deploying the backer plate into its extended locking position. Once a location of the clip on the trim strip has been selected, the backer plate can be extended to secure the clip on the trim strip.

The clip is locked in position on the trim strip by tightening a screw assembled through the trim attachment leg into the backer plate. Tightening of the screw pinches or clamps a part of a respective track channel on the rear side of the trim in which the backer plate is received. Since the clamping force is not directed against a mid-section of the trim strip, there is no risk of damaging the appearance of the trim strip. The clamping force of the screw is spread across relatively large flat areas of the trim so that permanent local deformation of the trim is avoided. Consequently, fine readjustment of the position of the clip is not obstructed by edges or bumps which could otherwise be created in the clamped trim area. The grid runner attachment leg incorporates a horizontal cut line that allows a technician to easily modify this leg to mate with different grid runner configurations.

DESCRIPTION OF THE PREFERRED EMBODIMENT

Figure 1:
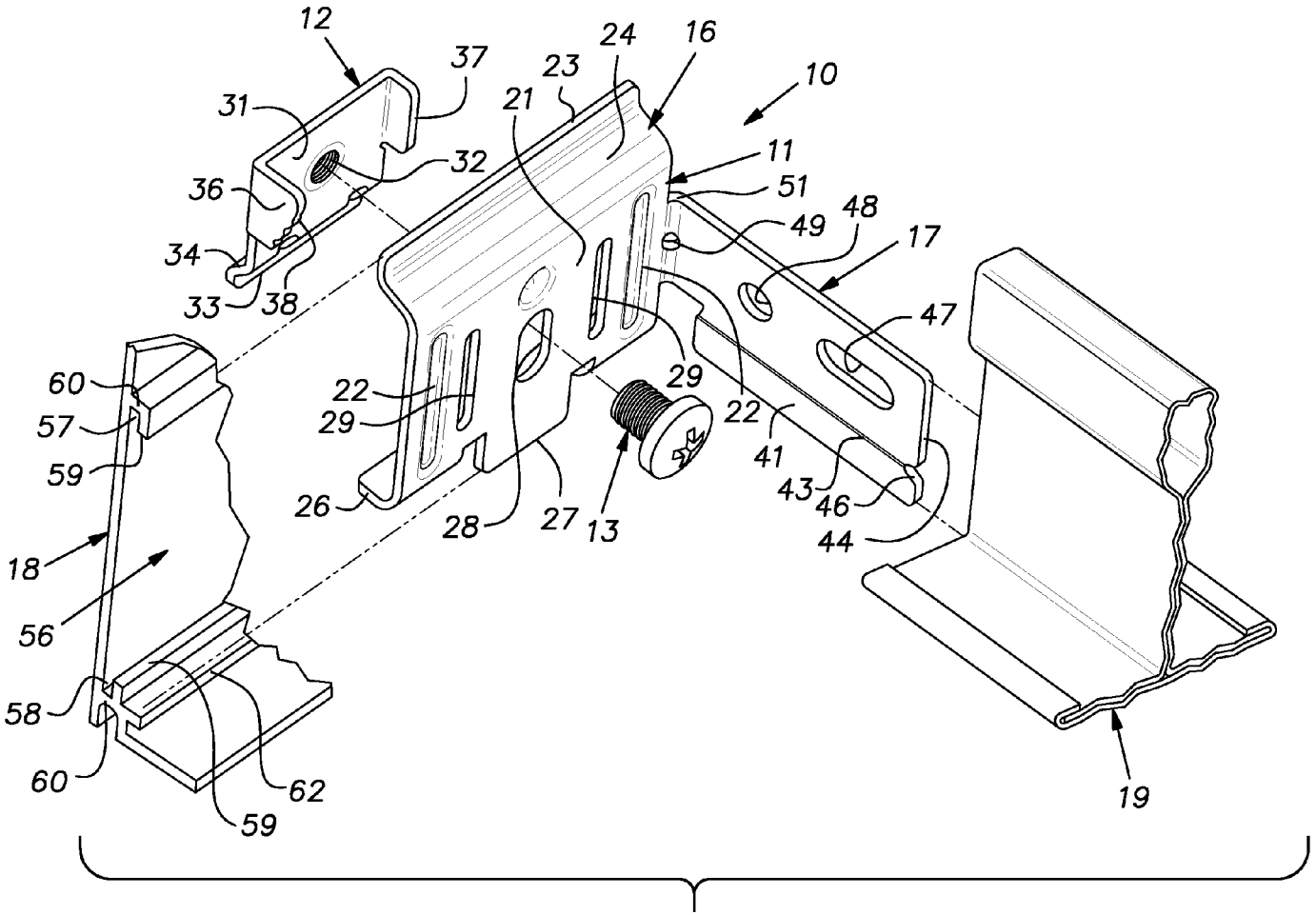
FIG. 1 is an exploded isometric view of the attachment clip of the invention, and portions of an exemplary grid runner and exemplary trim strip.
Figure 2:
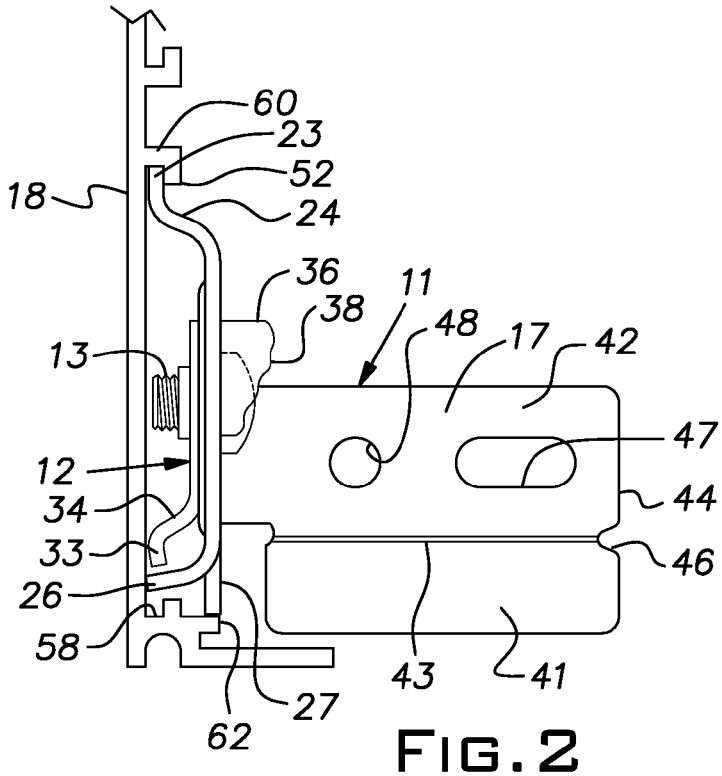
FIG. 2 is a side view of the attachment clip provisionally set on a trim strip.

Referring now to the figures, an attachment clip 10 has a main body 11, a backer plate 12, and a machine screw 13. The main body 11 and backer plate 12 are preferably shaped from steel sheet stock, of for example 19 gauge zinc plated material, into their illustrated configurations. The main body 11 has intersecting legs 16, 17 which can be supplied in a right angle configuration and which in use typically lie in vertical planes. A larger one of the legs 16 attaches with a trim strip 18 and a smaller one of the legs 17 attaches with a grid runner 19. It will be understood by those working in the art that, while only one grid runner is illustrated, a typical suspension grid will have numerous grid runners intersecting one or more trim strips 18.

The leg 16 has a generally planar rectangular mid-section 21 reinforced with vertical embossments 22 adjacent its ends. At an upper side, the leg 16 has a forwardly offset upstanding flange 23 joined to the mid-section 21 with a web 24. On a lower side of the mid-section 21 are a pair of spaced forwardly extending feet 26 and a central coplanar depending tab 27. A through slot 28 at a middle of the leg mid-section 21 receives the screw 13 with sufficient clearance to allow the screw to move freely vertically along the slot. Two narrow vertical through slots 29 are provided laterally or horizontally outward of the central screw receiving slot 28.

The backer plate 12 has a generally planar vertical central portion 31 with an internally threaded hole 32. At a lower edge, the backer plate 12 has a forwardly offset generally vertical flange 33 and an intermediate inclined web 34. At its vertical edges, the backer plate 12 includes a pair of tabs 36, 37 bent rearwardly at right angles to the main portion 31 of the backer plate. The tabs 36, 37 are proportioned to be received and slide in the slots 29 of the leg 16. The tab 36 extends through the plane of the leg mid-section 21 and includes a stepped edge 38. The stepped edge facilitates a person using a thumb or other finger to move the backer plate 12 up or down relative to the leg 16.

The leg 17, which is unitary with the trim engaging leg 16, is a generally planar part with a generally rectangular profile. A lower section 41 of the leg 17 is demarcated from an upper section 42 by a score line 43 stamped into the sheet stock of the clip 10. At a distal vertical edge 44, a notch 46 is aligned with the score line 43. A horizontally oriented through slot 47 and a hole 48 are stamped in the upper leg section 42. A hole 49 is punched in the clip 10 at a line 51 where the legs 16, 17 merge to weaken the line and assure that any bending between the legs will occur at this line.

The trim strip 18 preferably is an extruded aluminum product such as that marketed by USG Interiors, LLC under the trademark COMPASSO ELITE®. This product line offers trim strips of different heights, straight lengths and curved lengths all with generally constant cross-section. The trim strip 18 has an integral mounting track 56 formed on its rear face by a pair of opposed channels 57, 58. Each channel or groove 57, 58 is formed by a vertical flange 59 and a horizontal web 60.

The backer plate 12 is retained in assembled relation to the main body 11 with the screw 13 assembled through the slot 28 and threaded into the backer plate hole 32. The head of the screw 13 faces the clip leg 17. With the backer plate 12 initially in a raised position on the leg 16, the flange 23 can be inserted in the upper groove or channel 57. The clip 10 can thus be assembled on the trim strip 18 by positioning it in the mounting track 56 at any desired location, there being no need to slide it from one of the trim strip ends.

With the clip 10 in a selected position on a trim strip 18, the backer plate 12 can be lowered so that its flange 33 is received in the lower groove 58 of the mounting track 56. The screw 13 can be tightened to draw the flange 33 towards the vertical track flange 59 while the distal ends of the feet 26 bear against the rear face of the trim strip 18. As a result, the clip 10 is clamped and locked in place on the trim strip 18.

Figure 3:
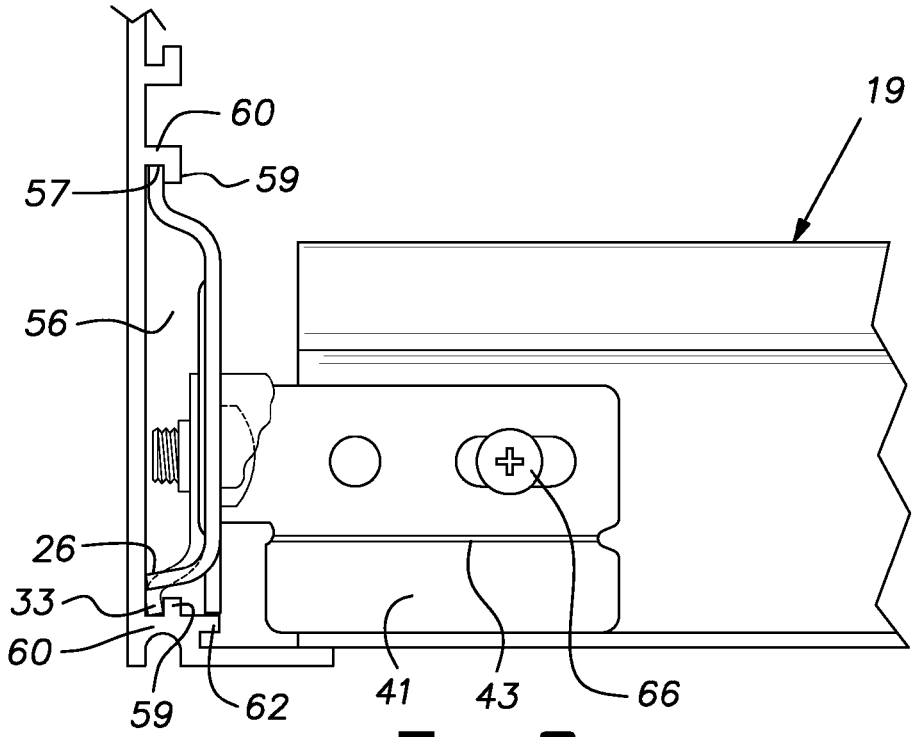
FIG. 3 is a side view of the attachment clip assembled and locked on the trim strip and a grid runner attached to the clip.

The illustrated grid runner 19 has a conventional inverted T-shape. The clip 10 is attached to the grid runner with a self-tapping screw 66, as shown in FIG. 3, assembled through the leg slot 47. A suspension wire, not shown, can be passed through the hole 48 for supporting the suspension grid and trim strip 18.

The location of the clip 10 along the length of the trim strip 18 can be readily adjusted from a position at which it is initially locked. Small adjustments are not made difficult since the broad clamping areas of the flange 33 and feet 26 avoid local deformation of the softer aluminum of the trim strip 18. Consequently, no dimple or other deformation is created in the trim strip proper or in the track flange 59 which would otherwise prevent the clip from smoothly relocating.

The lower section 41 of the grid runner attachment leg 17 can be removed with a tin snips or like tool. The blades of the snips can be located in the notch 46 and the leg 17 can be cut along the score line 43. Removal of the lower section 41 permits the clip 10 to be used with a so-called screw slot style grid runner. The screw 66 is driven into a web of the tee or grid runner 19 that extends between the lower flange and upper reinforcing bulb. The leg 17 abuts the grid runner web.

Where the grid runner 19 intersects the trim strip 18 at an obtuse or acute angle, the leg 17 can be bent at the bend line 51 so that the legs 16, 17 conform to the respective orientations of the grid runner and trim strip.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A stamped sheet metal clip for attaching an elongated trim strip to a grid runner in an angular relationship, the clip having a first leg for attachment to the trim strip and a second leg for attachment to the grid runner, the first leg having a backer plate attached with a screw, the screw extending through a slot in the first leg, a head of the screw being disposed on a side of the first leg facing the second leg, the backer plate being disposed on a side of the first leg opposing the side facing the second leg, an upper edge of the first leg being adapted to fit in an upper downwardly facing groove formed by a depending upper free edge of the trim strip on a back side of the trim strip, the backer plate being adapted to pass between the depending free edge of the upper groove and an upstanding lower free edge of the trim strip on the back side of the trim strip forming a lower upwardly facing groove when the screw attaching the backer plate is in an upper part of the slot, and being adapted to be received in the lower groove when the screw is in a lower part of the slot and to clamp against the lower foot free edge as a lower part of the first leg bears against the rear face of the trim strip at a location above the lower free edge and a depending tab of the first leg rests on a lower part of the trim strip; wherein the first leg has a midsection, the depending tab projecting in a direction parallel to the midsection and the lower foot part projecting in a direction substantially perpendicular to the midsection, the depending tab and the lower foot part being downwardly spaced from the upper edge.

2. An attachment clip as set forth in claim 1, wherein the backer plate has a tab extending through a narrow slot in the first leg, the tab having a length greater than the thickness of the first leg such that it is engageable by a finger of a technician installing the clip to manipulate the backer plate in or out of engagement with the lower groove.

3. An attachment clip as set forth in claim 1, wherein the backer plate has a second tab extending into a second narrow slot in the first leg parallel to said first narrow slot.

4. An attachment clip as set forth in claim 1, wherein said second leg is formed with an aperture.

5. An attachment clip as set forth in claim 4, wherein said aperture is an elongated slot.

6. A attachment clip as set forth in claim 5, wherein said second leg is horizontally scored to facilitate cutting a lower portion of the second leg from the clip to accommodate a grid runner with a lower flange having a box-like configuration.

* * * * *